United States Patent [19]

Telle et al.

[11] 4,040,476

[45] Aug. 9, 1977

[54] KEEL COOLER WITH SPIRAL FLUTED TUBES

[75] Inventors: Byron J. Telle, Louisville; John R. Sudyk, Huntsburg, both of Ohio

[73] Assignee: The Johnson Rubber Company, Chagrin Falls, Ohio

[21] Appl. No.: 594,289

[22] Filed: July 9, 1975

[51] Int. Cl.[2] ..... F28F 9/04

[52] U.S. Cl. ..... 165/76; 165/44; 115/75; 285/158; 285/137 R

[58] Field of Search ..... 165/44, 76, 81, 82, 165/173–175; 285/DIG. 19, 137 R, 373, 419; 115/.5

[56] References Cited

U.S. PATENT DOCUMENTS

| | | | |
|---|---|---|---|
| 770,599 | 9/1904 | Monteagle | 165/184 X |
| 2,258,526 | 10/1941 | Walter | 165/44 X |
| 2,356,844 | 8/1944 | Higgins | 165/44 |
| 2,415,154 | 2/1947 | Walter | 165/44 X |
| 2,703,719 | 3/1955 | Crothers | 285/DIG. 19 |
| 3,177,936 | 4/1965 | Walter | 285/172 X |
| 3,561,524 | 2/1971 | Satterthwaite | 165/44 |

FOREIGN PATENT DOCUMENTS

| | | | |
|---|---|---|---|
| 101,548 | 1/1918 | United Kingdom | 165/44 |

*Primary Examiner*—Carroll B. Dority, Jr.
*Assistant Examiner*—Theophil W. Streule, Jr.
*Attorney, Agent, or Firm*—McNenny, Pearne, Gordon, Gail, Dickinson & Schiller

[57] ABSTRACT

A keel cooler type heat exchanger is disclosed which is mounted on the exterior of the hull of a vessel or the like. The hull is curved in the direction of the length of the heat exchanger. The heat exchanger includes a pair of spaced headers secured to the hull and helically fluted tubes connected between the headers and curved in the direction of their length to substantially match the curvature of the hull. One or more intermediate tube supports are located between the headers. The helically fluted tube is laterally bendable with less stress than corresponding non-helically fluted tubes. The headers include separable members having cooperating tube and gripping portions formed along the interface therebetween. Bolt fasteners extend between the lowermost header member and a mounting plate. Separate fasteners separately and temporarily secure the inner member against the mounting plate and intermediate members against the inner member to facilitate the assembly and disassembly of the system.

7 Claims, 3 Drawing Figures

KEEL COOLER WITH SPIRAL FLUTED TUBES

BACKGROUND OF THE INVENTION

This invention relates generally to heat exchangers and more particularly to a novel and improved heat exchanger structure for external installation on marine vessels or the like.

PRIOR ART

The patent to Satterthwaite, U.S. Pat. No. 3,561,524 issued Feb. 9, 1971, discloses an improved marine keel cooler. Such keel cooler provides spaced headers which are externally mounted on the hull of a ship and heat exchanger tubes supported by and extending between the headers. In the illustrated embodiment, the tubes are formed with axially extending flutes or convolutions which are intended to increase the heat exchange capacity of the tubes.

The patent to Walter, U.S. Pat. No. 3,177,936 issued Apr. 13, 1965, discloses another form of marine keel cooler having fluted heat exchanger tubes. This patent also discloses a helical baffle within the tubes which are asserted to improve the heat exchange efficiency of the tubes.

SUMMARY OF THE INVENTION

The present invention relates to a marine keel cooler of the same type illustrated in the U.S. Pat. No. 3,561,524, supra. In accordance with one aspect of this invention, a novel and improved marine keel cooler is provided with spirally or helically fluted heat exchanger tubes, which extend between headers mounted on a curved hull. The tubes are mounted so that they are curved in a lengthwise direction to substantially match the curvature of the associated portion of the hull. The spiral fluting functions to provide improved heat exchanger efficiency and also improves lateral flexibility of the tube so that a given amount of lateral deflection produces smaller stresses in the tube than would exist in a similar cylindrical tube or axially fluted tubes. Since the stresses are low, the tendency of the tube to fail under fatigue are reduced. Also, the flexibility of the tubes improves its ability to withstand impact and other loads which may be imposed thereon.

In accordance with another aspect of this invention, an improved header structure is provided to ease the assembly and disassembly of the heat exchanger. The illustrated headers are provided with two or more separable header members which are provided with tube gripping surfaces along the joint therebetween. The tube gripping surfaces cooperate to grip and seal with the tubes. The assembled headers are secured to a mounting plate, which is permanently mounted on the ship's hull by a plurality of threaded fasteners which extend through the separable members and are threaded into the plate.

In order to facilitate installation and repair of the heat exchanger, separate threaded fasteners are provided to separately secure the inner separable member to the mounting plate and to separately secure the next adjacent separable member to such inner member. With this structure it is not necessary to support all of the header parts until they are secured by the principal fasteners.

These and other aspects of this invention are more fully described and disclosed in the following description and drawings.

BRIEF DESCRIPTION OF THE DRAWINGS

FIG. 1 is a side elevation of a heat exchanger in accordance with the present invention, illustrated installed on a curved section of a ship's hull or the like;

DETAILED DESCRIPTION OF THE DRAWINGS

Figure 1:
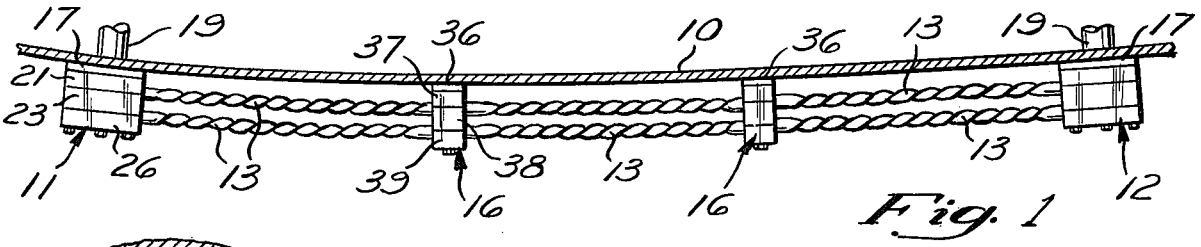

FIG. 1 illustrates a typical installation of the heat exchanger system mounted on the exterior of a ship's hull 10. Such heat exchanger system is often referred to as a keel cooler. In the illustrated embodiment, the hull 10 is formed with a curve in the direction of the length of the heat exchanger. Mounted on the hull at spaced locations are first and second header assemblies 11 and 12, and extending between the headers are a plurality of helically fluted or convoluted heat exchanger tubes 13. Located between the headers 11 and 12 are one or more support assemblies 16, which are secured to the hull 10 and operate to support the tubes 13. The support of the tubes by the headers 11 and 12 and by the support assembly 16 is arranged so that the tubes are curved along their length to conform to the curvature of the hull 10.

The helical fluting of the tubes functions to improve the heat transfer between the surrounding fluid and the fluid flowing between the headers through the tubes, and also provides a lateral flexibility of the tubes so that they can be conformed to the curvature of the hull with a minimum stress within the material forming the tubes. With the helically fluted structure, the stress within the tubes is less than it would be in a corresponding cylindrical tube formed of similar dimensions and material, and also less than the stress which would occur in an axially fluted tube of the type illustrated in the Satterthwaite patent, supra.

Because the stresses in the tube are lower due to the helical fluted configuration, the tendency of the tube to fatigue is reduced and the tube is better able to withstand external loads which may be applied during the use of the heat exchanger. Further, the lateral flexibility of the tubes in accordance with this invention permits the heat exchanger to be mounted on highly curved sections of the ship's hull, without encountering stressed difficulties.

The headers 11 and 12 are similar in many respects to the structure disclosed in the Satterthwaite patent, supra, and such patent is incorporated herein by reference.

Figure 2:
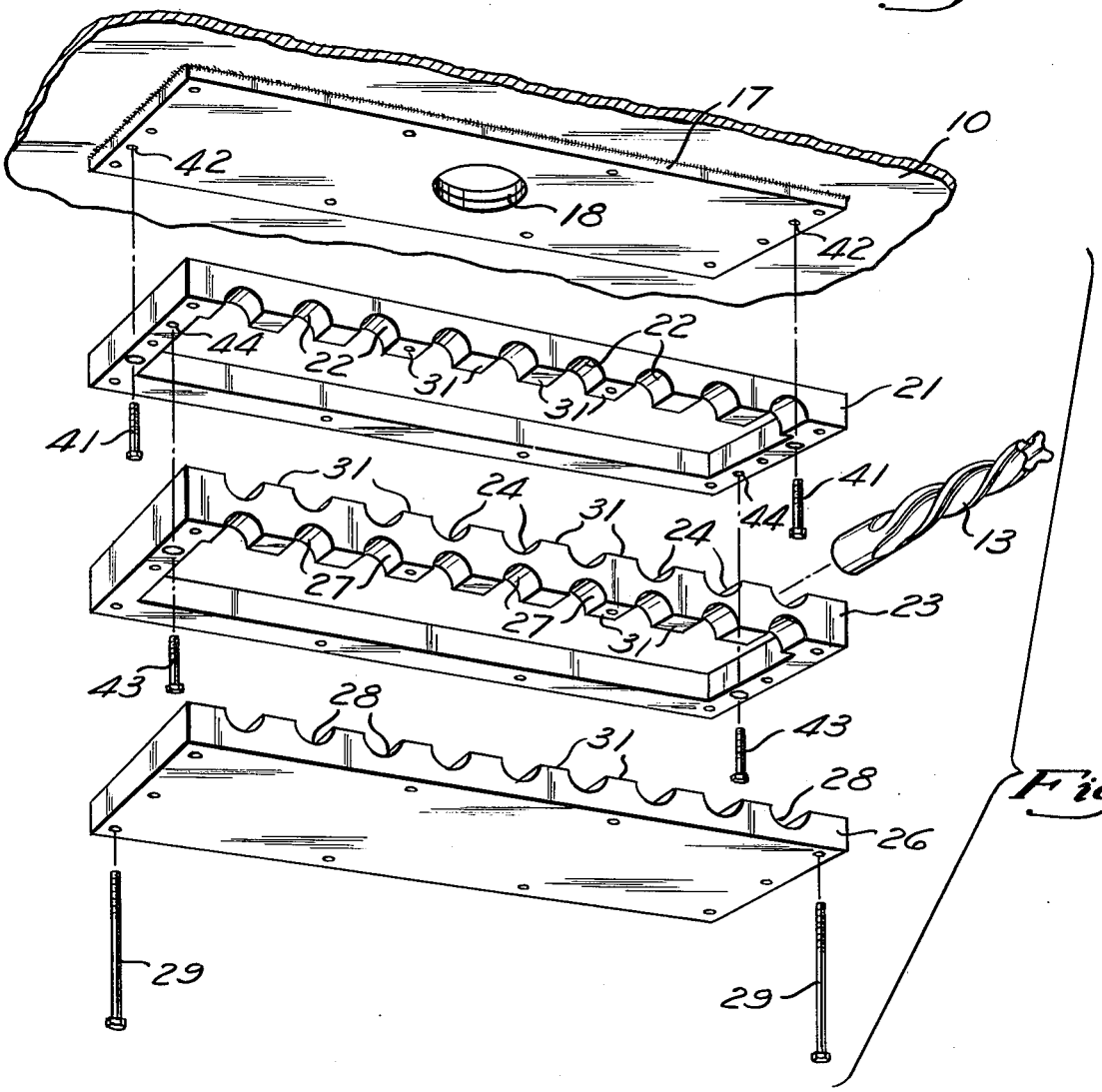
FIG. 2 is an exploded perspective view illustrating the structure for separately securing the header members in position; and, FIG. 3 is an enlarged fragmentary view of a preferred header member structure in accordance with the present invention.

FIG. 2 is an exploded perspective view of one of the headers. Since both headers have essentially the same structure, this figure can be applied to either of the headers 11 and 12. The header assembly includes a mounting plate 17, permanently mounted on the hull 10 by welding or the like. A port or opening 18 is provided through both the mounting plate and the hull to provide a fluid connection between the header chamber and the internal ship system. A pipe 19 (illustrated in FIG. 1) is connected to the header through the openings 18 and provides the means for connecting the heat exchanger to the system serviced thereby.

An inner header section 21 is provided with a generally rectangular section and is adapted to be secured to the mounting plate in sealing relationship therewith. The inner header section 21 is provided with a plurality of tube gripping portions 22, having a semi-cylindrical shape. In the illustrated embodiment there are nine tube gripping portions 22. An intermediate header section 23 is proportioned to fit against the inner header section 21 and is, again, provided with a plurality of semi-cylindrical tube gripping portions 24, which cooperate when the header is assembled with the tube gripping portions 22 to encircle the end of a tube 13 and to provide a sealing and gripping support with the end of the tube. Here again, there are nine tube gripping portions 24, located to cooperate with the tube gripping portions 22 on the inner header section.

The illustrated header also includes a cover or lower section 26, which is adapted to fit against the lower side of the intermediate header section and to close the header assembly when installed. Here again, tube gripping portions 27 and 28 of semi-cylindrical shape are provided on the intermediate header section and the cover header section 26 so that a second group of nine heat exchanger tubes 13 are clamped by these sections. Thus, in the illustrated embodiment, the header assembly is arranged to accommodate a total of eighteen tubes 13. It should be understood that header assemblies can be arranged to provide only the inner header section 21 and the lower header section 26 without an intermediate header section 23, when a single bank of heat exchanger tubes is required. Similarly, in some installations, it may be desirable to provide two or more intermediate header sections 23 to increase the number of banks of heat exchanger tubes which can be accommodated in the total system.

The final assembly of the header in the clamping engagement on the tubes is provided by a plurality of threaded fasteners 29, which extend through the three header sections and thread into the mounting plate 17 to clamp the header sections together and to cause them to, in turn, clamp the heat exchanger tubes 13. In practice, a fastener 29 is provided through each land 31 between the tube gripping portions. However, for purposes of illustration and for simplicity, a full compliment of fasteners 29 and corresponding passages through the headers is not illustrated in FIG. 2. Similarly, a greater number of fasteners is normally provided around the other margins of the header assembly than the number illustrated in FIG. 2.

Preferably, the header sections are formed of a rigid core material such as bronze or the like, which is completely encased with and covered by a layer of elastomeric material. The elastomeric material functions to provide the necessary sealing connection between the adjacent header sections as well as the tube gripping and seal function. Further, the elastomeric material protects the core metal from exposure to the elements. Further, the sections are normally provided with means to allow the header chamber to be separated by separator members as disclosed in the Satterthwaite patent, supra. Such an arrangement (not illustrated) permits the heat exchanger to be divided into different and separated systems, or permits some of the heat exchanger tubes to be connected in a series manner rather than in a parallel manner.

The structure of the support assemblies 16 is similar to the structure of the header sections along the wall in which the tubes are mounted. In the illustrated embodiment, the support assemblies 16 include a mounting plate 36 permanently secured to the hull 10 and three support sections 37, 38 and 39, which are bolted to the mounting plate. These sections are provided with mating semi-cylindrical tube gripping sections along their interface so that each tube is tightly gripped and is thereby fully and separately supported by the support assembly. The illustrated tube 13 is formed with a cylindrical, unfluted end section which extends into the headers for gripping and the tube is also provided with a cylindrical unfluted section at the locations where the support assemblies 16 are mounted.

In accordance with one aspect of this invention, a structure is provided to facilitate the assembly and disassembly of the headers and the entire heat exchanger. This structure includes provisions for separately securing the inner header section 21 to the mounting plate 17. This separate structure for securing the inner header section 21 is not intended to constitute any material part of the fastening of the total header assembly together, but merely a means for holding the inner header assembly in its mounted position while the tubes and other header sections are either being installed or removed. The structure for holding the inner header section 21 against the mounting plate 17 includes a pair of threaded fasteners 41 which are located at diametrically opposite locations with respect to the inner header section 21 and are adapted to project through corresponding openings therein and thread into the mounting plate at 42. The fasteners 41 are preferably of the bolt type and are proportioned to extend only through the inner header section. Preferably, the inner header section 21 is formed with head receiving recesses so that when the fasteners 41 are installed, they do not project beyond the face of the header section 21.

Similarly, means are provided to secure the intermediate header section 23 to the inner header section 21 to temporarily secure these parts together during assembly and disassembly. This means includes a pair of bolt type fasteners 43, which are adapted to extend through associated openings in the intermediate header section 23 and to thread into openings 44 formed in the inner header section 21. In this way, the two header sections 21 and 23 can be temporarily connected together and can operate to hold the inner bank of tubes while the outer bank of tubes is being assembled or disassembled. The provisions of these means for temporarily mounting partial portions of the headers and tubes greatly facilitates the installation and disassembly of the heat exchanger since it eliminates the requirement of separately holding, usually manually, all of the various elements of the heat exchanger together and then attempting to fasten the headers to the mounting plates as a unit, rather than as parts of a unit.

Figure 3:
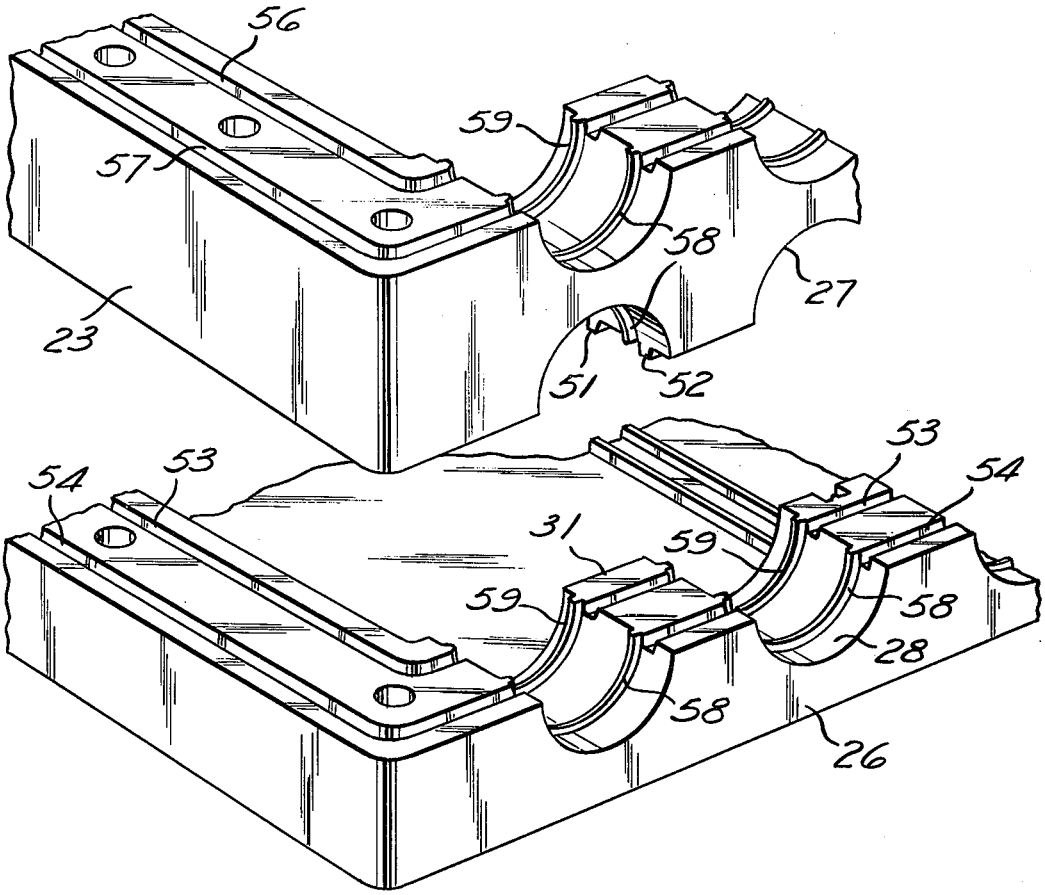

Referring to FIG. 3, the header sections are illustrated in enlarged fragmentary perspective sections. As illustrated, the outer sections are preferably formed with tongue and groove type sealing means along the interface between the sections. For example, the lower side of the intermediate section 23 is formed with a pair of spaced tongues 51 and 52, which are proportioned to extend into and provide sealing engagement with spaced grooves 53 and 54, respectively, formed in the header section 26. Similarly, the upper face of the intermediate section is formed with grooves 56 and 57, proportioned to receive tongues formed on the inner header section 21.

The header sections are also preferably formed with projecting ribs 58 and 59, which cooperate to seal against the heat exchanger tubes and provide zones of localized high pressure to insure adequate sealing. In some instances, elastomeric rings or sleeves (not illustrated) may be positioned over the end of the tubes 13 to permit the gripping of smaller size tubes within a given size clamping or gripping portion formed in the header sections. The structure in the tongue and grooves and the tube gripping ribs is arranged so that a header can be assembled with or without intermediate header sections and with more than one intermediate header section if desired.

The support assemblies 16 are proportioned to provide the same tube spacing as the headers. Further, the tubes are formed with unfluted cylindrical portions which are located within the support assemblies. It has been found that a satisfactory system results when support assemblies 16 are provided so that the unsupported length of tubes is between about three and four and one half feet when the tubing is about one and one half inch in diameter and is formed of 90 — 10 copper-nickel, about 0.030 inches thick.

Although a preferred embodiment of this invention is illustrated, it should be understood that various modifications and rearrangements of parts may be resorted to without departing from the scope of the invention disclosed and claimed herein.

What is claimed is:

1. An elongated marine heat exchanger system comprising a supporting hull having a curvature in the direction of the length of said system, a pair of spaced headers secured to said hull at the ends of said system, a substantially continuously helically fluted heat exchanger tube connected at each end to one of said headers for a flow of fluid between said headers, said tube being supported so that it is curved along its length to substantially match the curvature of said hull, said helical fluting of said tube permitting said tube to assume such curved condition with substantially less strain than a tube of similar size and material without helical fluting and to transfer heat between the fluid circulated through such tube and the fluid surrounding such tube at a greater rate than a tube of similar size and material without helical fluting, said fluted tube providing cylindrical ends which are supported by said headers and intermediate cylindrical portions, and intermediate supports connected between said intermediate cylindrical portions and said hull to support said tube at locations between its ends.

2. An elongated marine heat exchanger system as set forth in claim 1 wherein said tube is supported by said intermediate supports at locations along its length so that the unsupported lengths of said tubes is about three feet to four and one-half feet and said tubes have a diameter of about one and one-half inches.

3. A marine heat exchanger as set forth in claim 1 wherein said headers are formed of separable sections providing semi-cylindrical tube gripping portions along the joint therebetween proportioned to grip said cylindrical end portions with a fluid tight joint, said cylindrical end portions having a diameter at least substantially equal to the maximum diameter of the tube adjacent to such cylindrical end portions so that said tubes can be moved axially with respect to said headers for installation and removal without moving said headers toward and away from each other.

4. A heat exchanger comprising at least a pair of spaced headers, a heat exchanger tube extending between said headers, said headers including first and second separable members formed with tube gripping surfaces along the joint therebetween which cooperate with associated tube gripping surfaces on the other member to grip said tube, said first member being adapted to be secured against a supporting surface and said second member being adapted to be secured to said first member and in turn said support surface by first fastening means which extend from said second member to said supporting surface, separate second fastening means for separately securing said first member to said supporting surface during the assembly and disassembly of said headers, said headers including third members adapted to be secured to said second members by said first fastening means, said second and third members including tube gripping surfaces along the joint therebetween which cooperate with associated tube gripping surfaces on the other member to grip a tube, and separate means are provided for separately securing said second member to said first member during assembly and disassembly of said headers.

5. A heat exchanger as set forth in claim 4 wherein said members are provided with mating tongues and grooves which provide a fluid tight joint therebetween.

6. A heat exchanger as set forth in claim 5 wherein said tube gripping surfaces are provided with ribs to provide localized high pressure with said tube.

7. A heat exchanger as set forth in claim 4 wherein said tube is helically fluted and is sufficiently flexible to permit it to be curved to match the curvature of the hull of a vessel or the like.

* * * * *